US011730241B2

(12) United States Patent
Zane et al.

(10) Patent No.: US 11,730,241 B2
(45) Date of Patent: Aug. 22, 2023

(54) CARD HOLDING WALLET

(71) Applicants: Tobe G. Zane, Redding, CA (US); Jordan M. Zane, Redding, CA (US)

(72) Inventors: Tobe G. Zane, Redding, CA (US); Jordan M. Zane, Redding, CA (US)

( * ) Notice: Subject to any disclaimer, the term of this patent is extended or adjusted under 35 U.S.C. 154(b) by 533 days.

(21) Appl. No.: 16/776,408

(22) Filed: Jan. 29, 2020

(65) Prior Publication Data

US 2020/0237063 A1 Jul. 30, 2020

Related U.S. Application Data

(60) Provisional application No. 62/798,097, filed on Jan. 29, 2019.

(51) Int. Cl.
*A45C 1/06* (2006.01)
*A45F 5/02* (2006.01)

(52) U.S. Cl.
CPC ..... *A45C 1/06* (2013.01); *A45F 5/021* (2013.01); *A45C 2001/065* (2013.01)

(58) Field of Classification Search
CPC ... A45C 2001/065; A45C 1/06; A45C 11/182; A45F 5/021
See application file for complete search history.

(56) References Cited

U.S. PATENT DOCUMENTS

| | | | | |
|---|---|---|---|---|
| 2014/0020798 | A1* | 1/2014 | Kitchen | A45C 11/182 150/137 |
| 2015/0342314 | A1* | 12/2015 | Christy | A45C 11/182 206/38 |
| 2016/0035212 | A1* | 2/2016 | Gorzelic | G08B 21/24 340/539.32 |
| 2019/0380458 | A1* | 12/2019 | Muldowney, Jr. | A45C 11/182 |
| 2020/0214410 | A1* | 7/2020 | Del Moral | A45C 11/321 |

* cited by examiner

*Primary Examiner* — Sue A Weaver
(74) *Attorney, Agent, or Firm* — Donn K. Harms

(57) ABSTRACT

A wallet is provided having a body adapted to hold credit cards, currency, and business cards. The credit cards are insertable to a biased engagement in a first compartment between two flexible members. A second compartment is positioned below the first compartment and configured to hold currency therein in biased contact between a biasing panel and a credit card in the first compartment. A third compartment is provided and configured to hold business cards.

15 Claims, 4 Drawing Sheets

CARD HOLDING WALLET

This application claims priority to U.S. Provisional Patent Application Ser. No. 62/798,097 filed on Jan. 29, 2019, which in incorporated herein in its entirety by this reference thereto.

FIELD OF THE INVENTION

The present device relates to a wallet and the like. More particularly, the device herein relates to a wallet configured for secure compartmentalized holding of credit cards, currency, and business cards and identification cards, all in secure but easily accessed compartments.

BACKGROUND OF THE INVENTION

Conventional billfolds or wallets are employed by people throughout the world, to provide an organized container for users to carry currency, credit cards, identification, and business cards as well as other items. Such wallets are conventionally manufactured from animal skin or synthetic materials and are formed with pockets and slots for the user to employ for storage.

However, by their design, conventional wallets tend to become disorganized and also are subject to becoming ever more bulky over time. This makes items stored in such wallets hard to find. Further, as the wallet becomes ever more bulky, when stowed in a back pocket, they form a large bump on which the user must sit when in a chair or seated in a car or the like. This is most uncomfortable and where users lean or otherwise adjust their posture to accommodate the wallet on which they are sitting, it can cause long term medical issues from misaligned joints.

Still further, many users employ such wallets which are carried in a pocket separate from currency, which is also located in that pocket. When removing the wallet to find a credit card or business card, it can cause currency or change located in the same pocket to fall to the ground. Frequently, such goes unnoticed at the expense of the user.

The device herein disclosed and described provides a compact compartmentalized wallet which is easy to use on an ongoing basis.

The forgoing examples of wallets and billfolds are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The device herein provides a significant improvement in the design and function of wallets and billfolds. The wallet device herein is configured to be light weight and compact to easily fit in a pants pocket of a user without forming a significant and unsightly bulge. In all modes of the device, the wallet features a light weight body which is configured with a plurality of compartments where each is configured for ease of use.

In all modes of the device, a housing or body is configured to provide separate storage compartments which are adapted to hold items conventionally carried by users of conventional wallets and billfolds. A first such compartment is configured for secure holding of a plurality of credit cards and/or credit card sized items. This first compartment is formed on a first side of the body of the device and features two different openings allowing input and removal of the credit cards from either side of the body. Once inserted into the first compartment, a pair of biased arms or flexible members, on opposing sides of the first compartment, biasly contact against the end surface of inserted credit cards and the like, to hold them within the first compartment.

By providing two openings and a biased contact against inserted cards, the device also allows the user to shuffle amongst the cards held in the first compartment, without totally removing them, to find a single card amongst the plurality to remove it. The remainder of the cards in the first compartment are easily repositioned in an aligned stack within the first compartment once the chosen card has been removed.

The opposing openings to the first compartment are provided by flexible members on opposing sides of the compartment. A first of the flexible members has a first end engaged with the body of the wallet and extends to a movable distal end positioned on one side of the first opening. A second of the flexible members is engaged at a first end to the body on the same side on which the distal end of the first flexible member is positioned. This second flexible member extends to a distal end which is positioned on one side of the second opening.

With this configuration, the first flexible member will deflect upon engagement of a card into the first compartment through the first opening, and the second flexible member will deflect and allow insertion of a card into the first compartment through the second opening. The distal ends of both flexible members will each contact one side of the stacked cards positioned in the first compartment, thereby holding them in place in a biased compressive engagement between the distal ends of both flexible members. A shuffling of the cards back and forth can be accomplished to find one card amongst the plurality for removal, which can be removed without removing the rest of the credit cards held in the first compartment.

A second compartment is provided which is positioned within a recess surmounted by a rear wall on one side thereof and a perimeter sidewall of the body about the perimeter of the formed recess. This recess is configured for insertion of folded currency.

A biasing panel may be positioned within the second compartment. This biasing panel is sized substantially the same or at least half the size of the area of the second compartment. The biasing panel is formed in a corrugated shaped or curved or non planar shape and of material which bends upon insertion of currency or other items into the second compartment. Spring steel or flexible plastic are material for such.

The biasing panel in operative position communicates force from its curved or bent form against any currency placed in the second compartment between the rear wall and the credit card held in the first compartment which is adjacent the second compartment. The biasing panel, thus, holds the currency or other item in a biased engagement between the biasing panel and the credit card placed on the opposite side of the second compartment from the rear wall of the body of the device.

A third compartment is formed between the biasing panel and the rear wall of the device. Slots on opposing sides of the rear wall of the body of the device, provide access to the recess formed into the body defining third compartment. Business cards, or identification cards or the like, inserted from either slot into the third compartment are held in the slot by the width thereof being substantially equal to a conventional business card and may be held by a biased compressive engagement between the biasing panel and the rear wall of the body of the device.

The length of the rear wall for the distance between the opposing slots is preferably shorter than the length of a business card or credit card. This allows side portions of credit cards or identification cards and the like, when inserted into the third compartment, to extend from both opposing slots. These side portions provide a gripping area to the user to remove the respective card from the third compartment by pulling it therefrom. Notches formed into rear surfaces of both the first and second flexible members provide a gap adjacent the slots providing access to the third compartment. These notches provide space for a finger of the user to contact one side of the cards held in the third compartment more easily, to grasp and pull them.

Optionally a belt clip can be positioned in an engagement to the body adjacent the rear wall. This will allow the user to clip the body and the device onto a belt. The body can also be adapted for removable engagement to a cell phone or the case engaging around a cell phone.

With respect to the above description, before explaining at least one preferred embodiment of the herein disclosed compartmentalized wallet invention in detail, it is to be understood that the invention is not limited in its application to the details of construction and to the arrangement of the components in the following description or illustrated in the drawings. The wallet invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other compartmentalized wallet devices and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. The term "substantially" when employed herein, means plus or minus twenty-percent unless otherwise specifically designated in a different range.

It is an object of the present invention to provide a wallet having secure but easily accessed compartments for holding credit cards, currency, and other card type materials therein.

It is a further object to provide such a wallet device which is compact in size to minimize the area occupied within a pocket in which it is carried.

These and other objects, features, and advantages of the present compartmentalized wallet herein, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed wallet. It is intended that the embodiments and figures disclosed herein are to be considered illustrative of the invention herein, rather than limiting in any fashion. In the drawings.

Figure 3:
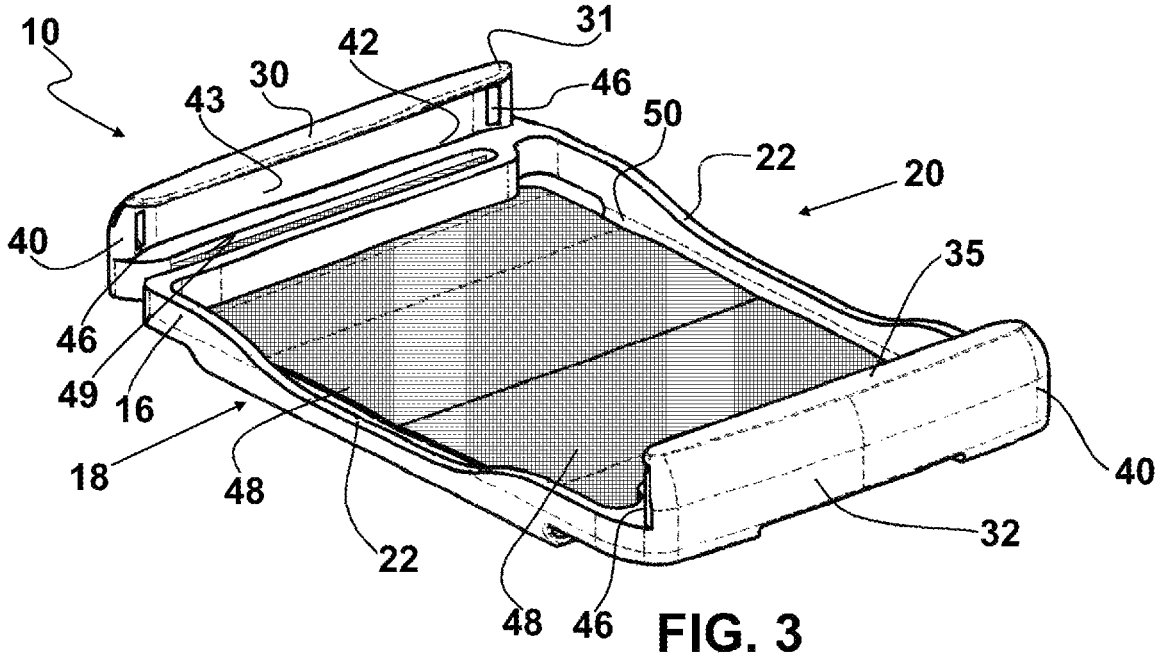
FIG. 3 shows a perspective view of the device as in FIG. 1 with the credit cards removed from the first compartment and showing the biasing panel located in the bottom of the second compartment.
Figure 4:
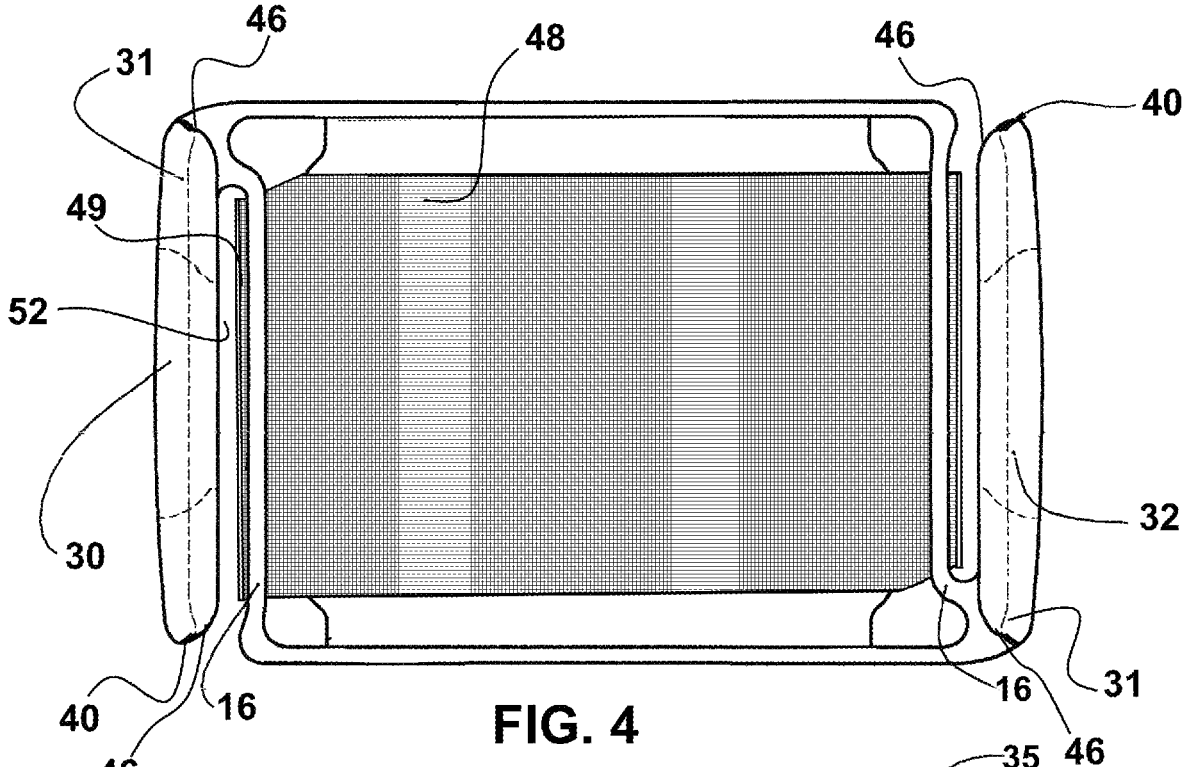
FIG. 4 is a top view of the device as in FIG. 3, and shows the positioning of the biasing panel in the bottom of the second compartment and held in place by projecting portions on both ends positioned in gaps in the body of the device.
Figure 5:
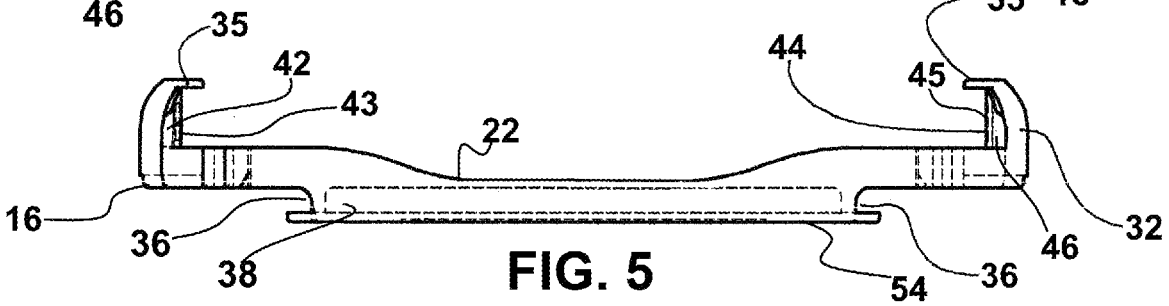

FIG. 5 shows a side view of the body of the device of FIGS. 3-4 and shows one opening communicating into the first compartment formed between facing surfaces of the first and second flexible members and showing ramps formed on opposite sides of the opening to provide mechanical advantage for the user inserting a card into the first compartment. The second opening on the opposite side is a mirror image thereof.

Figure 1:
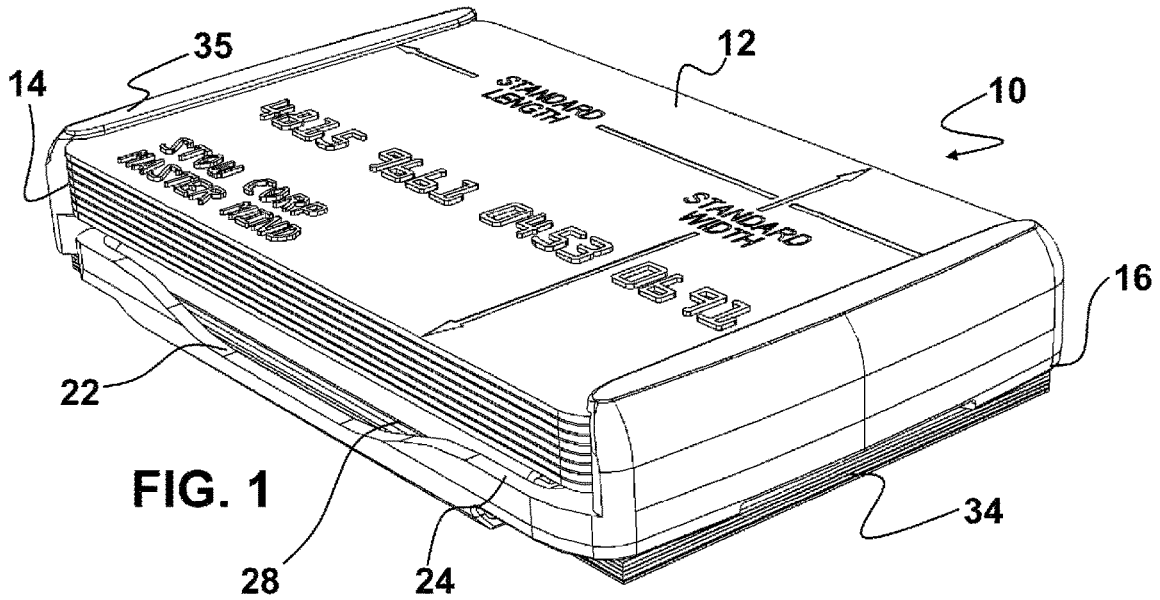
FIG. 1 depicts a perspective view of the device showing a plurality of credit cards held in a first compartment and a body recess formed below a first opening formed between flexible members which provides access for insertion of currency located in a second compartment. The top of the card inserted is viewable while within the first compartment.
Figure 6:
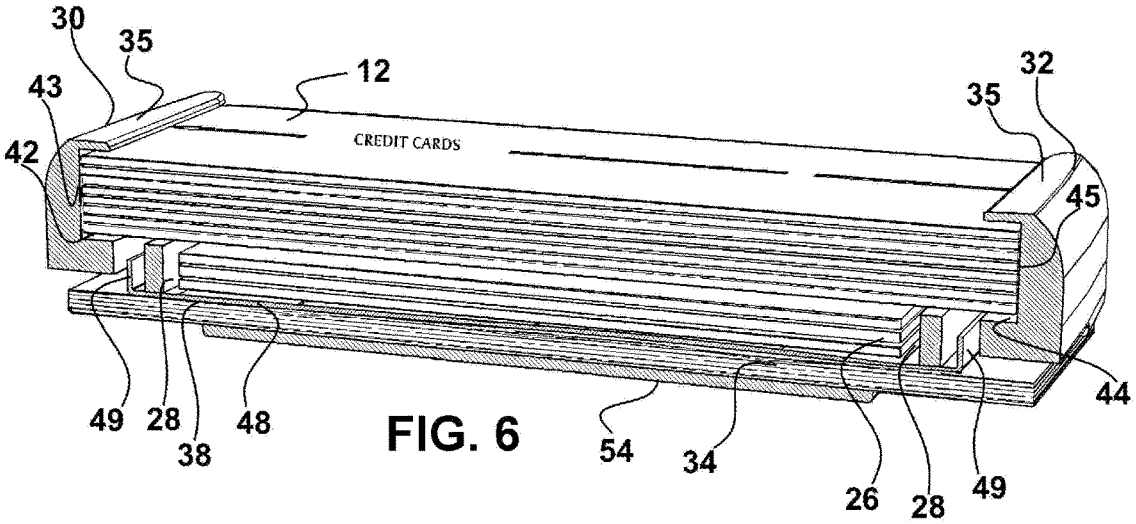

FIG. 6 is a sectional view through the device, as in FIG. 1, and shows the credit cards compressibly engaged at opposing ends which are in contact with a recessed surface formed on both flexible members and showing currency held in the second compartment and business cards in the third compartment.

Figure 2:
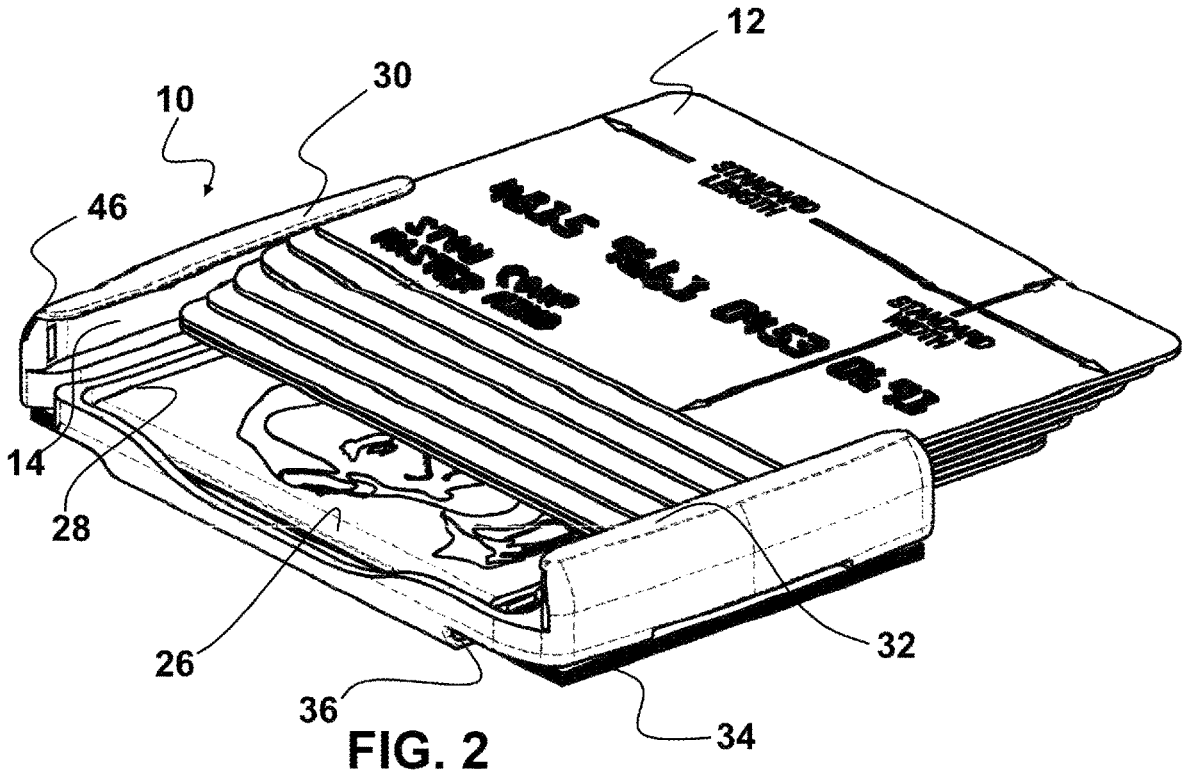
FIG. 2 depicts the device herein showing a plurality of credit cards in a shuffled position extending from a first opening formed on the body of the device which is employable to insert and remove cards therefrom, and showing currency stowed in a second compartment.
Figure 7:
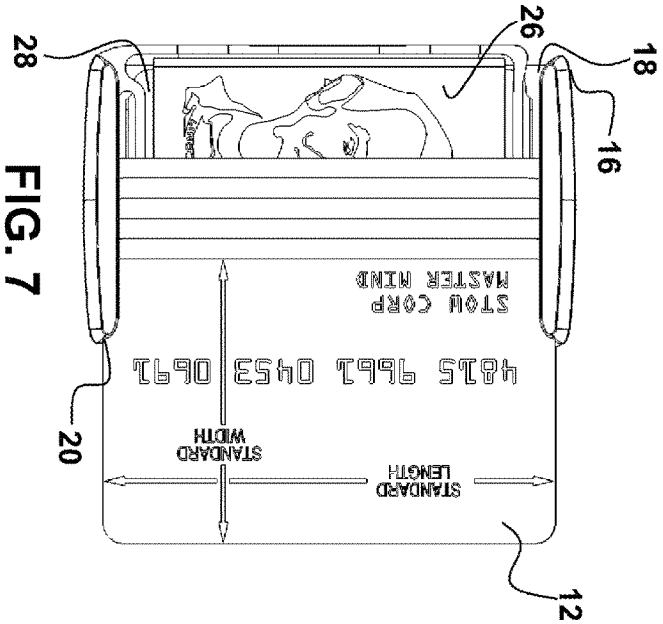

FIG. 7 is an overhead view of the device as in FIG. 2, showing the credit card continuing to be held in the compressive engagement between the flexible members while being removed or inserted from a first side of the body.

Figure 8:
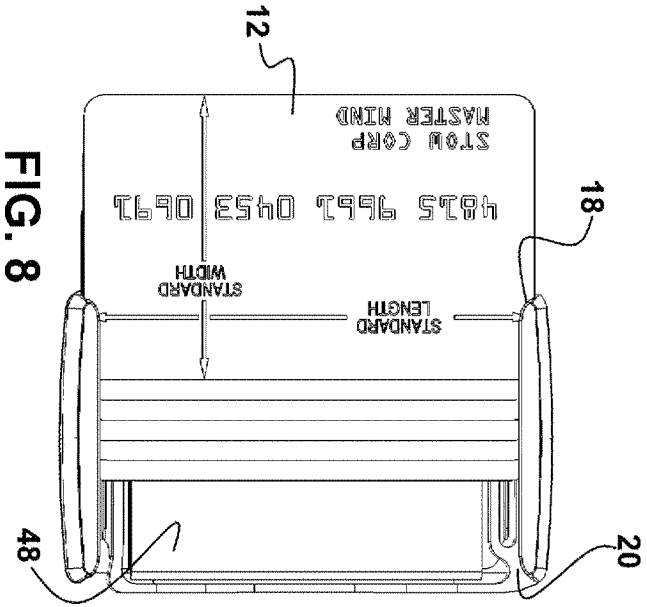

FIG. 8 is an overhead view as in FIG. 7, showing that the credit cards are insertable into and removable from the first compartment, from either the first or second openings.

Figure 9:
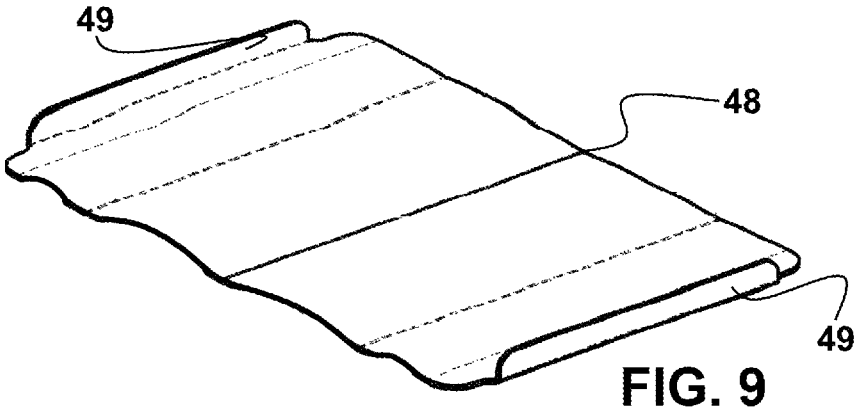

FIG. 9 is a perspective view of a mode of the biasing panel showing non planar portions thereof which flex to act as a biasing spring.

Figure 10:
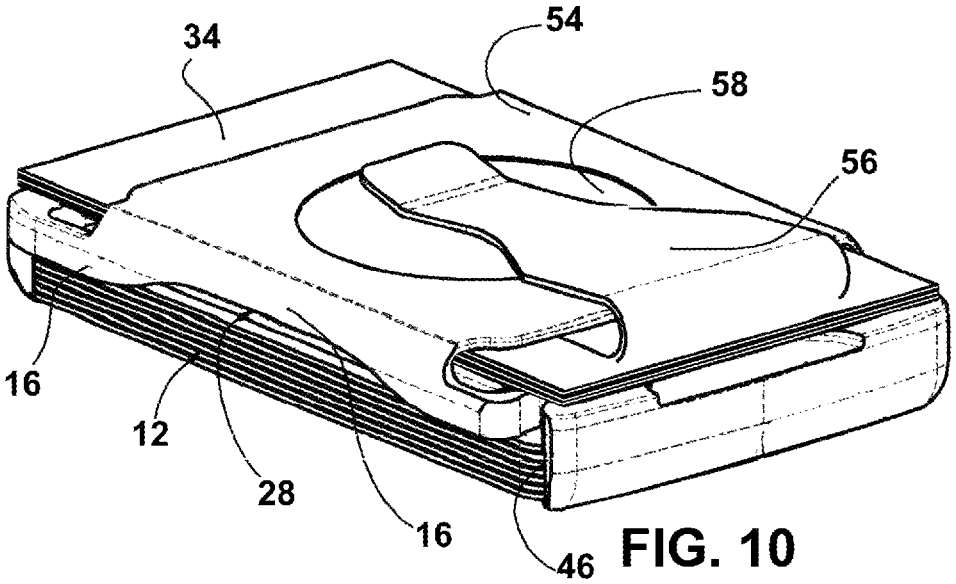

FIG. 10 depicts a mode of the device which includes a belt clip.

Figure 11:
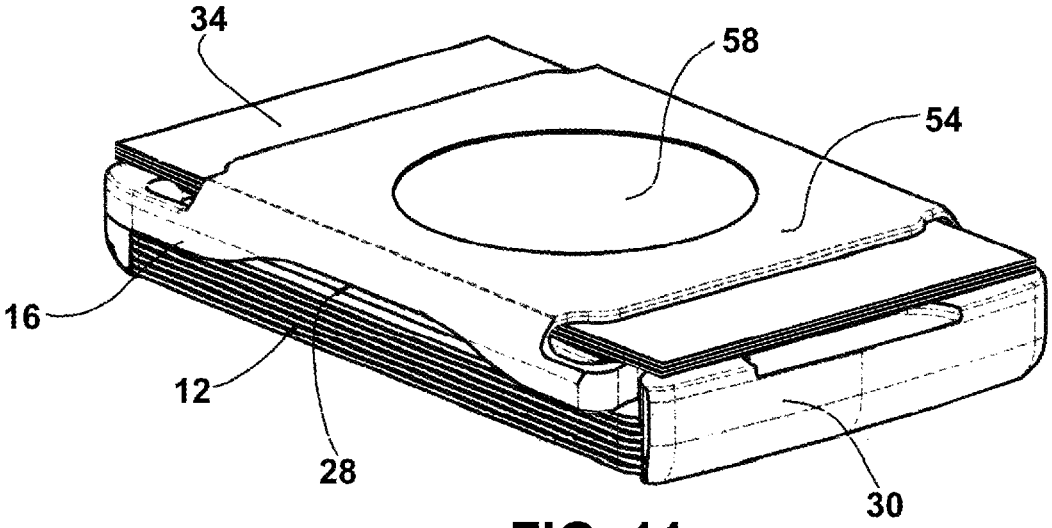

FIG. 11 shows a mode of the device which can include a GPS or similar beacon which transmits through WiFi or cellular frequencies to identify a location for the device, if lost.

DETAILED DESCRIPTION OF THE INVENTION

In this description, the directional prepositions of up, upwardly, down, downwardly, front, back, top, upper, bottom, lower, left, right and other such terms refer to the device as it is oriented and appears in the drawings and are used for convenience only and such are not intended to be limiting or to imply that the device has to be used or positioned in any particular orientation.

Now referring to drawings in FIGS. 1-11, wherein similar components are identified by like reference numerals, there is seen in FIG. 1, the device 10, in one preferred mode. FIG. 1 depicts a perspective view of the device 10 depicting it in operative mode having a plurality of credit cards 12 held in a stacked configuration within a first compartment 14 formed in the body 16 of the device 10.

A first opening 18 is formed on a first side of the body 16 opposite a second opening 20 (FIG. 3). Both of these openings provide access to the first compartment 14 to insert and remove credit cards 12 therefrom. A body recess 22 is formed into a ledge 24 which runs along the first side of the body 16 under the first opening 18. This body recess 22 provides access therethrough to slide currency 26 (FIG. 2) into and out of the second compartment 28 (FIG. 2).

Shown in FIG. 2 is the device 10 having a first opening 18 on one side and a second opening 20 on the opposite side of the body 14, which allows the user to fan or shuffle the credit cards 12 to view or access currency 26 in the second compartment 28 or to pick one card and remove it. As noted herein, the credit cards 12, when stacked or shuffled, are held in a biased compressive engagement between the first flexible member 30 and the second flexible member 32. The biased engagement continues even when only part of the credit card is inserted into one of the openings, making it easy to shuffle the credit cards back and forth while still maintaining them in the first compartment 14. Secondary cards 34 such as business cards, drivers licenses, or other identification cards are shown with end portions extending from slots 36 communicating into the third compartment 38 (FIG. 5).

In FIGS. 3-5 are shown different views of the device 10 with the credit cards 12, currency 26, and secondary cards 34 removed for clarity. As shown, the body 16 has the first flexible member 30 engaged at a proximal end 31 defining a first side edge of the first opening 18 and extending to a distal end 40 which defines a first side edge of the second opening. The second flexible member 32 runs the opposite direction from a proximal end 31 engaged with the body 16 forming a second side edge of the second opening 20 opposite the first side edge formed by the distal end of the first flexible member 30, to a distal end 40 of the second flexible member 32 defining a second side edge of the first opening 18 opposite the first side edge formed by the distal end 31 of the first flexible member 30. Thus, each of the first and second opening has a deflectable distal end 40 of one flexible member on one side and the fixed proximal end 31 of one of the flexible members on the other side.

Central portions of the facing sides of each of the first flexible member 30 and the second flexible member 32 have a rectangular recess formed therein. The first rectangular recess 42, shown in FIG. 3, positioned on the facing side of the first flexible member 30, which faces the first compartment 14 and the credit cards 12 therein, has a planar recessed surface 43 running a length configured to contact against the length of one of the shorter opposing edges of a credit card. Currently, a preferred length is a length sized to engage opposing ends of a credit card. By sized to engage opposing ends is meant between 2.125 inches and 2.2 inches so as to hold the short opposing ends of the credit card placed therein in a biased engagement and to prevent sliding.

The elongated recessed surface 43 has a width, preferably, to allow for stacking of a plurality of credit cards 12 where each in the stack will contact a portion of the recessed surface 43. The second recess 44 (FIG. 5) is positioned opposite and substantially parallel and aligned with the first recess 42. The second recess 44 has a planar recessed surface 45 of the same length and width as the first recessed surface 43.

A distance between the first recessed surface 43 and the second recessed surface 45 is substantially equal to or just slightly larger than the longitudinal length of a credit card which currently is preferred as between 3.3 inches to 3.5 inches with 3.36 inches being a current favorite distance. Experimentation has shown that with the first recessed surface 43 distanced from the second recessed surface 45, with both the first flexible member 30 and the second flexible member 32, both in a static or in an un-flexed position, that the credit cards 12 are held in the first compartment 14 in a biased engagement between the first flexible member 30 and second flexible member 32. Further projections 35 (FIG. 5) overhang both sides of each credit card 12 held in the first compartment 14. This prevents a vertical removal and requires sliding either through the first opening 18 or second opening 20 for removal.

Also preferred in all modes of the device, and as shown in FIGS. 3-5 for example, is the positioning of beveled or angled surfaces 46 on both sides of the first opening 18 and the second opening 20. The beveled surfaces angle outward from a first end adjacent the recess 42 and 44 to a second end. The beveled surfaces define ramps. When a credit card 12 is inserted into the first recess 42, the leading ends of the credit card 12 contact respective beveled edges, and the force of the user pushing on the card 12 causes the distal end of the first flexible member 30 to momentarily bend in a direction away from the first opening 18, while the credit card 12 is slid into contact with the first recess 42 and the second recess 44. Beveled edge portions 46 on opposite sides of the second opening 20 function in the same manner.

Also shown in FIGS. 3-5 are the biasing panel 48 which is positioned within a recess formed into the body 16 which forms the second compartment 28. As shown in FIGS. 1-2 when credit cards 12 are operatively held in the first compartment 14, one of the stacked credit cards 12 will abut the top edge of the cavity 50 forming the second compartment 28 in which the biasing panel 48 is positioned. Thus, the second compartment 28, as used herein, is defined by the area between the credit card 12 positioned on the open side of the cavity 50 and the biasing panel 48.

As noted, the biasing panel 48 is formed to be undulating or curving or angled such that portions of it project out of plane. In this fashion, when formed of elastic or flexible material such as spring steel or polymeric material, portions of the biasing panel 48 will rise or project toward and into the area of the second compartment 28. With currency 26 positioned therein, the biasing panel 48 will hold it in a compressed engagement between the projecting portion of the biasing panel 48 and the credit card 12 located at the open end of the cavity 50 in the body 16. End sections 49 of the biasing panel 48, at opposite ends thereof, run substantially normal to the plane of the biasing panel 48 and project upward. Each of the end sections 49, as seen in FIG. 4, may be positioned in a respective slot 52 which is located in between the first flexible member 30 and the second flexible member 32 and a central portion of the body 16.

In FIG. 5, is shown, in dotted line, the third compartment 38 positioned between an endwall 54 of the body 16 and the biasing panel 48 located in the bottom of the second compartment 28. A slot 36 on both sides of the body 16 provides communication into the third compartment 38. The third compartment 38, as noted, is adapted to hold secondary cards 34, such as business cards therein. To that end, the distance or length of the endwall 54, in between the two slots 36, is less than the length of a business card or substantially 2.5 inches so as to allow a inch card portion to extend out of each of the slots 36 when the device 10 is holding such secondary cards 34. Further, in order to form a tight biased contact with the sides of business cards positioned through the first slot 36 and second slot 36 and within the third compartment 38, it is preferred that the slots 36 have a width of substantially two inches. By substantially is meant two inches plus or minus ten percent.

As noted, FIG. 6 shows a sectional view through the device 10 as in FIG. 1, and shows the device 10 in operative engagement in each of the three compartments. As shown, a plurality of stacked credit cards 12 are compressibly engaged at opposing ends by contact with the planar surface 43 of the first recess 42 and the planar surface 45 of the second recess 44. The projections 35 are defined by and overhang both of the recesses and prevent dislodgement or removal of the credit cards 12 vertically. By vertically is meant in a direction from the first compartment toward the projections 35.

Also, in FIG. 6, currency 26 is shown stowed in the second compartment 28 with the biasing panel 48 in biased contact with the currency 28. The end sections 49 of the biasing plate 48 are shown projecting into the slots 52 and the secondary cards 34 are shown engaged in the third compartment 38 in between the endwall 54 and the biasing panel 48.

FIGS. 7 and 8 depict the function provided by the device 10 where credit cards 12 can be loaded and removed from either the first opening 18 or the second opening 20. Additionally, they may be slid to one side or the other, to engage the credit cards partially, and will continue in the biased engagement between the two flexible members, while opening up the second compartment 28 to remove currency 26.

In FIG. 9 is shown an example of the biasing panel 48. As shown, the biasing panel 48 has projecting portions which are flexible and project out of plane and provide the biasing contact into the second compartment 28. End sections 49 are shown configured for engagement into the slots 52 to help maintain the biasing panel 48 in operative positioning.

In FIG. 10 is depicted a mode of the device 10 which includes belt clip 56. While in FIG. 11 is shown the device 10 having a GPS or similar beacon 58 which may transmit signals through WiFi or cellular frequencies to identify a location for the device if lost.

It should be noted that any of the different depicted and described configurations and components of the wallet device herein disclosed, can be employed with any other configuration or component shown and described as part of the device herein.

Additionally, while the present invention has been described herein with reference to particular embodiments thereof and/or steps in the method of production or use, a latitude of modifications, various changes and substitutions are intended in the foregoing disclosure, and it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A wallet, comprising:

a body extending from a first end to a second end;

a first flexible member extending to a distal end from a proximal end engaged to said body;

a second flexible member extending to a distal end from a proximal end thereof, engaged to said body;

a gap positioned between said first flexible member and said second flexible member;

said body having a first compartment positioned in said gap in between a first facing surface of said first flexible member and a second facing surface of said second flexible member;

a first opening on a first side of said body, said first opening communicating with said first compartment;

a second opening on a second side of said body, said second opening communicating with said compartment;

said distal end of said first flexible member forming a first side edge of said first opening;

said distal end of said second flexible member forming a first side edge of said second opening; and said first compartment sized to hold credit cards inserted therein through either of said first opening or said second opening, in a biased engagement of respective opposing ends of said credit cards with said first facing surface and said second facing surface and with a surface of said credit card viewable through said gap.

2. The wallet of claim 1, additionally comprising:

a first recess formed into said first facing surface;

a second recess formed into said second facing surface in a position aligned with said first recess;

said first recess having a length sized to contact one end of a credit card positioned in between said first flexible member and said second flexible member;

said second recess having a length sized to contact one end of a credit card positioned in between said first flexible member and said second flexible member, wherein in said biased engagement of said respective opposing ends of said credit cards with said first facing surface is a contact with one end of said credit card within said first recess, said biased engagement of said respective opposing ends of said credit cards with said second facing surface is a contact with one end of said credit card within said second recess.

3. The wallet of claim 2, additionally comprising:

a first projection formed on said first flexible member above said first recess;

a second projection formed on said second flexible member above said second recess; and said first projection and said second projection positioned to contact respective opposing ends of a credit card positioned within said first compartment.

4. The wallet of claim 1, additionally comprising:

a first ledge extending along said first side of said body in-between said first end of said body and said second end of said body;

a second ledge extending along said second side of said body in between said first end of said body and said second end of said body;

a biasing panel positioned in between said first ledge and said second ledge;

a second compartment within said body positioned between said first ledge and said second ledge and said biasing panel;

a first recess formed on said first ledge on said first side of said body and defining a first opening into said second compartment;

said second compartment sized for positioning of currency therein through said first opening to a stowed position; and said biasing panel forming a biased contact against said currency in said stowed position, said biasing contact for compressing said currency between said biasing panel and a credit card located in said first compartment.

5. The wallet of claim 2, additionally comprising:

a first ledge extending along said first side of said body in-between said first end of said body and said second end of said body;

a second ledge extending along said second side of said body in between said first end of said body and said second end of said body;

a biasing panel positioned in between said first ledge and said second ledge;

a second compartment within said body positioned between said first ledge and said second ledge and said biasing panel;

a first recess formed on said first ledge on said first side of said body and defining a first opening into said second compartment;

said second compartment sized for positioning of currency therein through said first opening to a stowed position; and said biasing panel forming a biased contact against said currency in said stowed position, said biasing contact for compressing said currency between said biasing panel and a credit card located in said first compartment.

6. The wallet of claim 3, additionally comprising:

a first ledge extending along said first side of said body in-between said first end of said body and said second end of said body;

a second ledge extending along said second side of said body in between said first end of said body and said second end of said body;

a biasing panel positioned in between said first ledge and said second ledge;

a second compartment within said body positioned between said first ledge and said second ledge and said biasing panel;

a first recess formed on said first ledge on said first side of said body and defining a first opening into said second compartment;

said second compartment sized for positioning of currency therein through said first opening to a stowed position; and said biasing panel forming a biased contact against said currency in said stowed position, said biasing contact for compressing said currency between said biasing panel and a credit card located in said first compartment.

7. The wallet of claim 4, additionally comprising:

an end wall having a first side thereof connected to said first ledge and having a second side thereof connected to said second ledge;

a third compartment positioned between said biasing panel and said end wall;

a first slot at a first end of said endwall communicating with said third compartment;

a second slot at a second end of said endwall communicating with said third compartment, said second slot in an alignment with said first slot; and said third compartment configured to hold business cards therein, with portions thereof projecting from both said first slot and said second slot.

8. The wallet of claim 5, additionally comprising:

an end wall having a first side thereof connected to said first ledge and having a second side thereof connected to said second ledge;

a third compartment positioned between said biasing panel and said end wall;

a first slot at a first end of said endwall communicating with said third compartment;

a second slot at a second end of said endwall communicating with said third compartment, said second slot in an alignment with said first slot; and said third compartment configured to hold business cards therein, with portions thereof projecting from both said first slot and said second slot.

9. The wallet of claim 6, additionally comprising:

an end wall having a first side thereof connected to said first ledge and having a second side thereof connected to said second ledge;

a third compartment positioned between said biasing panel and said end wall;

a first slot at a first end of said endwall communicating with said third compartment;

a second slot at a second end of said endwall communicating with said third compartment, said second slot in an alignment with said first slot; and said third compartment configured to hold business cards therein, with portions thereof projecting from both said first slot and said second slot.

10. The wallet of claim 7, additionally comprising:

a belt clip positioned on said end wall.

11. The wallet of claim 8, additionally comprising:

a belt clip positioned on said end wall.

12. The wallet of claim 4, additionally comprising:

a beacon positioned on said body; and said beacon configured to transmit a location of said wallet.

13. The wallet of claim 7, additionally comprising:

a beacon positioned on said body; and said beacon configured to transmit a location of said wallet.

14. A wallet, comprising:

a body extending from a first end to a second end thereof;

a first member extending to a distal end thereof from a proximal end engaged to said body;

a second member extending to a distal end thereof from a proximal end thereof, engaged to said body;

a gap positioned between said first member and said second flexible member;

said body having a first compartment positioned in said gap in between a first facing surface of said first member and a second facing surface of said second member;

a first opening on a first side of said body, said first opening communicating with said first compartment;

a second opening on a second side of said body, said second opening communicating with said compartment;

said distal end of said first member forming a first side edge of said first opening;

said distal end of said second member forming a first side edge of said second opening;

said first compartment sized to hold credit cards inserted therein through either of said first opening or said second opening in a stowed positioning; and said first facing surface and said second facing surface forming a biased engagement against respective opposing ends of said credit cards when inserted into said first compartment.

15. The wallet of claim 1, additionally comprising:

a first recess formed into said first facing surface;

a second recess formed into said second facing surface in a position opposite said first recess;

said first recess having a length sized to contact one end of a credit card positioned in between said first member and said second member;

said second recess having a length sized to contact one end of a credit card positioned in between said first member and said second member; and wherein in said biased engagement of said respective opposing ends of said credit cards with said first facing surface is a contact with one end of said credit cards within said first recess and said biased engagement of said respective opposing ends of said credit cards with said second facing surface is a contact with one end of said credit cards within said second recess.

* * * * *